US010612757B2

(12) United States Patent
Xiang et al.

(10) Patent No.: US 10,612,757 B2
(45) Date of Patent: Apr. 7, 2020

(54) SCALABLE MODULAR LED LIGHT FIXTURE WITH INTERCHANGEABLE MOUNTS

(71) Applicant: MAXLITE, INC., West Caldwell, NJ (US)

(72) Inventors: Jun Xiang, Parsippany, NJ (US); Francisco J. Garza, Tamiment, PA (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 16/655,948

(22) Filed: Oct. 17, 2019

(65) Prior Publication Data

US 2020/0049334 A1 Feb. 13, 2020

Related U.S. Application Data

(62) Division of application No. 15/364,461, filed on Nov. 30, 2016, now Pat. No. 10,473,309.

(60) Provisional application No. 62/261,523, filed on Dec. 1, 2015, provisional application No. 62/261,855, filed on Dec. 1, 2015.

(51) Int. Cl.

| | |
|---|---|
| ***F21V 21/14*** | (2006.01) |
| ***F21V 29/76*** | (2015.01) |
| ***F21V 15/015*** | (2006.01) |
| ***F21V 23/00*** | (2015.01) |
| ***F21S 2/00*** | (2016.01) |
| *F21Y 115/10* | (2016.01) |

(52) U.S. Cl.

CPC ..... *F21V 21/14* (2013.01); *F21S 2/005* (2013.01); *F21V 15/015* (2013.01); *F21V 23/003* (2013.01); *F21V 29/76* (2015.01); *F21Y 2115/10* (2016.08)

(58) Field of Classification Search

CPC ..... F21V 21/14; F21V 29/76; F21V 15/015; F21V 23/003; F21S 2/005

See application file for complete search history.

(56) References Cited

U.S. PATENT DOCUMENTS

2015/0260391 A1 9/2015 Wassel et al.

*Primary Examiner* — Thomas M Sember

(74) *Attorney, Agent, or Firm* — Budzyn IP Law, LLC

(57) ABSTRACT

A system of scalable modular LED light fixtures is provided herein for accommodating different levels of generated lighting and to accommodate different mountings.

7 Claims, 4 Drawing Sheets

SCALABLE MODULAR LED LIGHT FIXTURE WITH INTERCHANGEABLE MOUNTS

CROSS-REFERENCE TO RELATED APPLICATIONS

This application is a division of U.S. patent application Ser. No. 15/364,461, filed Nov. 30, 2016, now allowed, which claims priority to U.S. Provisional Patent Appl. No. 62/261,523, filed Dec. 1, 2015, and claims priority to U.S. Provisional Patent Appl. No. 62/261,855, filed Dec. 1, 2015, the entire contents of these filings being incorporated by reference herein.

FIELD OF THE INVENTION

The present invention relates to LED light fixtures, and more particularly, to scalable modular LED light fixtures configured to accommodate interchangeable mounts.

BACKGROUND OF THE INVENTION

Light emitting diode (LED) environmental lighting, including, for example, street lamps, parking lighting, pathway lighting, and so forth, is well known in the art. Such lighting may be configured with various constructions to provide different light distribution in accordance with various codes and requirements. Also, based on the applications, different mounting requirements may be involved.

SUMMARY OF THE INVENTION

A system of scalable modular LED light fixtures is provided herein for accommodating different levels of generated lighting and to accommodate different mountings.

DETAILED DESCRIPTION

Figure 1:
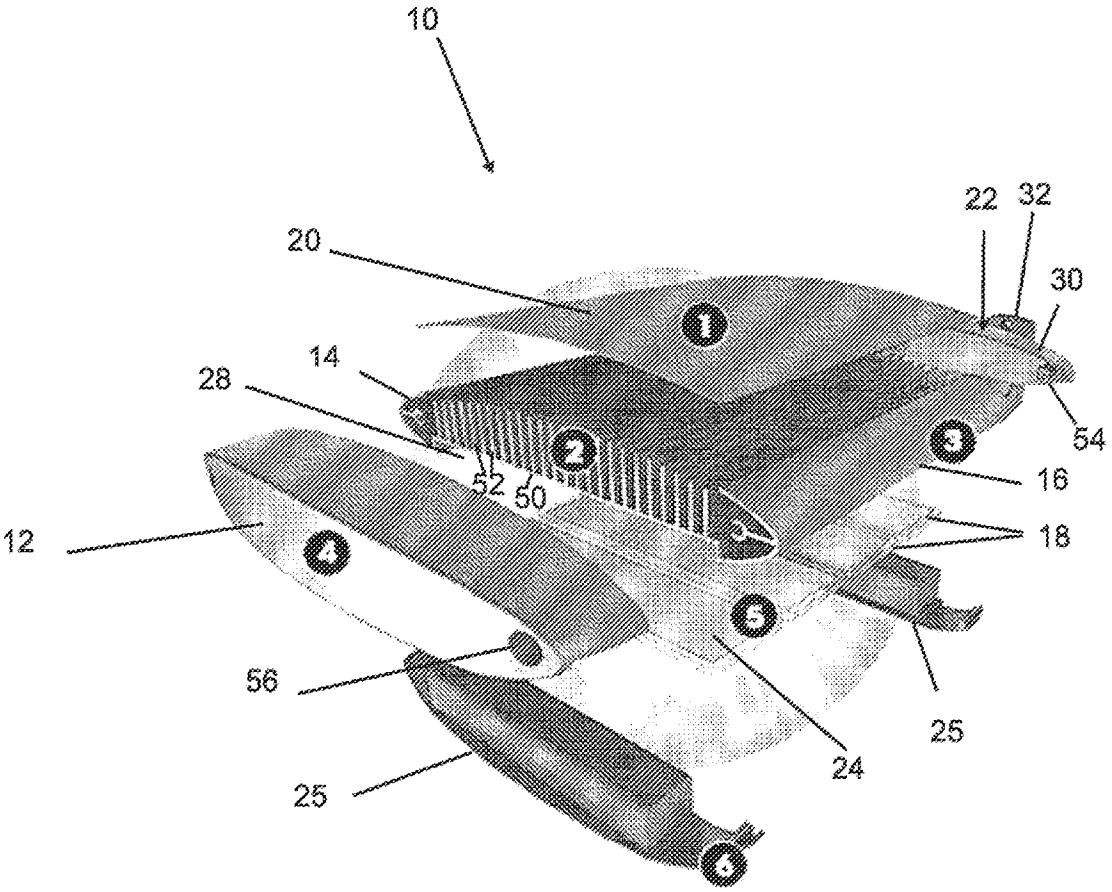
FIGS. 1 and 1B are exploded perspective views, respectively, of LED light fixtures formed in accordance with the subject invention.
Figure 1B:
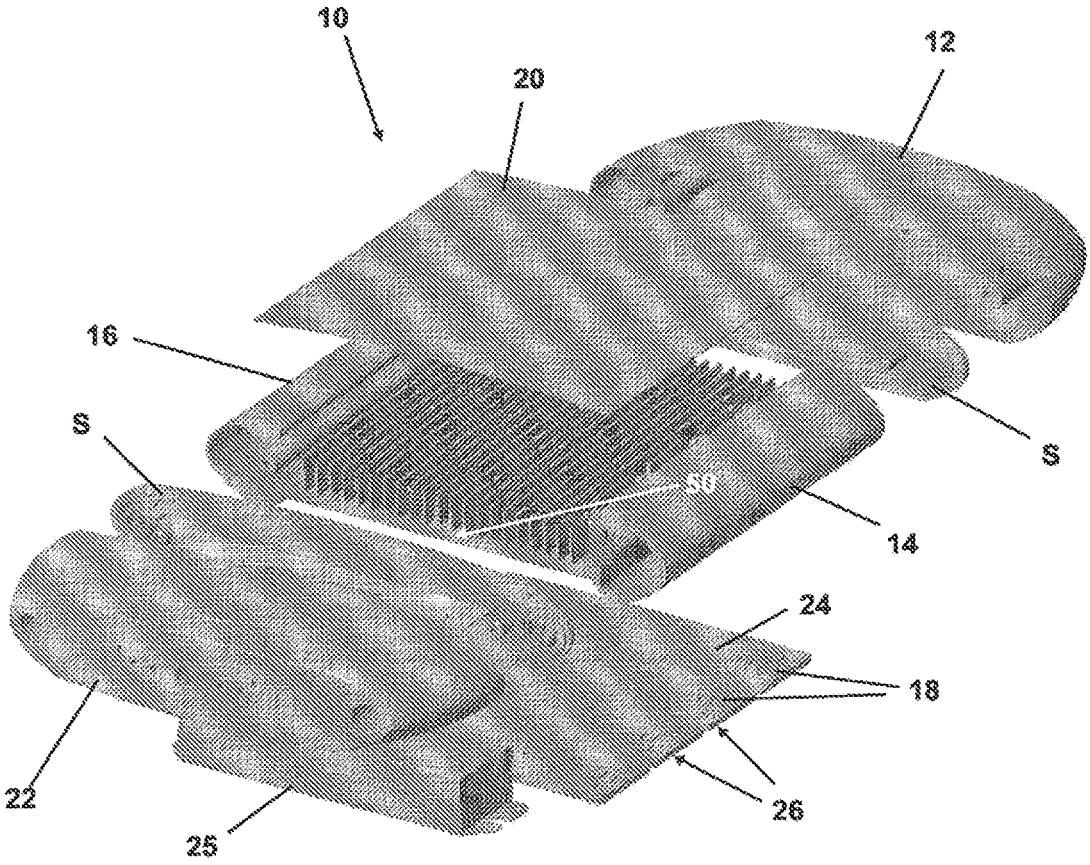

A system is provided herein of providing scalable, variable-mounting LED lighting fixtures. This system utilizes a "mix and match" type system of set inventory pieces to allow for the preparation of a plurality of differently-configured LED lighting fixtures. The LED lighting fixtures may be varied in light output and with mounting capability with a minimal number of pieces maintained in inventory. With reference to FIGS. 1 and 1B, the system yields a LED lighting fixture 10 generally having a front end cap 12, a first rail 14, a second rail 16, at least one LED light module 18, a housing cover 20 and a back end 22.

Each of the LED light modules 18 includes a base 24 to which is affixed a plurality of LED light elements 26 disposed to generate light outwardly from the LED lighting fixture 10. Any LED light elements which are electrically powered to generate light may be utilized. The LED light elements 26 are powered by one or more drivers provided with the LED light fixture 10, e.g., a driver provided with each of the LED light modules 18, and/or a source of direct current, such as a battery pack. One or more drivers may be secured to a portion of the LED lighting fixture 10, thus, being provided separately from the LED light modules 18, to power one or more of the LED light modules 18. As is known in the art, the driver(s) is each configured to convert alternating current to direct current to power the LED light elements 26. Lenses or other optics may be provided with each of the LED light modules 18 to diffuse or otherwise act on light generated by the LED light elements 26.

The driver(s) may be disposed in one or more enclosures 25 which optionally may be provided with the LED light fixture 10. The enclosure(s) 25 may be situated to have a panel-covered opening accessible from the outside. The enclosure(s) 25 may be housed wholly or partially within the front end cap 12 and/or the back end 22. Appropriate cut-outs may be defined in the front end cap 12 and/or the back end 22 to accommodate access to the enclosure(s) 25. The enclosure(s) 25 may be housed fully within the front end cap 12 and/or the back end 22. One or more separators S may be provided adjacent to the front end 12 and/or the back end 22 to limit ingress of contaminants behind the LED light modules 18.

The LED light modules 18 are preferably similarly dimensioned, including being provided with similarly-arranged LED light elements 26, so as to allow for fixed increments of lighting intensity with the selection of additional LED light modules 18. Thus, the LED light fixture 10 may be scaled to accommodate a particular lighting application. For example, each of the LED light modules 18 may be rated nominally for 25 watts. With this arrangement, lighting output may be "block" designed such that increasing or decreasing the number of LED light modules 18 results in corresponding increases or decreases in light output. In addition, the LED light modules 18 preferably each define the same general footprint (shape, dimensions). This may be achieved by configuring each of the bases 24 of the LED light modules 18 in similar manner.

As known in the art, various sensors, e.g., motion sensors, daylight sensors, may be utilized with the LED light modules 18 including being mounted on or in proximity to the LED light fixture 10. Other controls, such as switches, dimmers, etc. may be likewise utilized.

Figure 2:
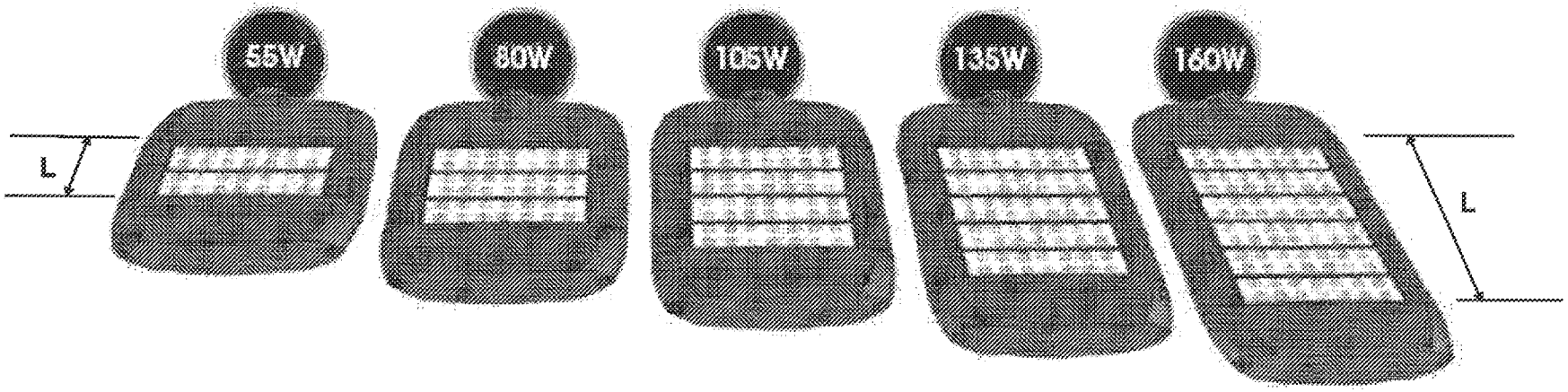
FIG. 2 shows different scaled LED light fixtures formed in accordance with the subject invention; and, FIGS. 3-10 show different mounting arrangements usable with the subject invention.
Figure 3:
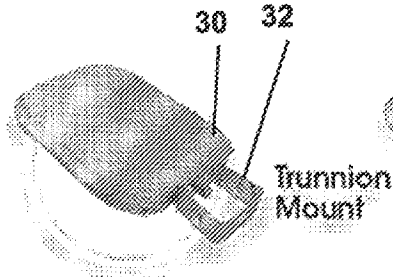
Figure 4:
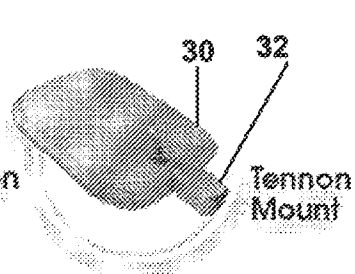
Figure 5:
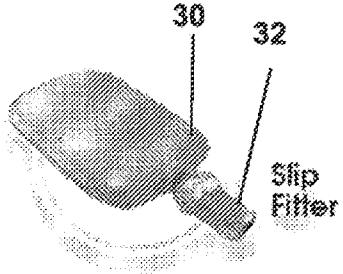
Figure 6:
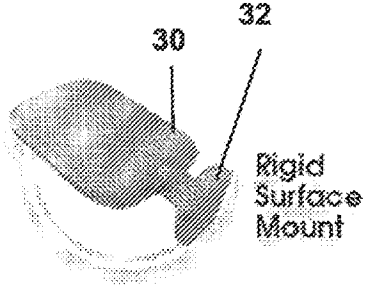
Figure 7:
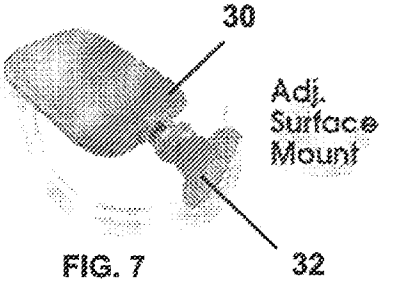
Figure 8:
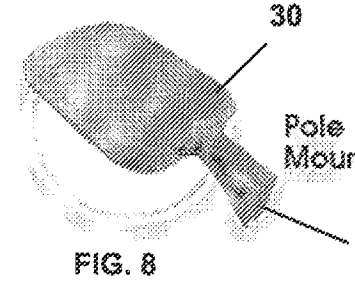
Figure 9:
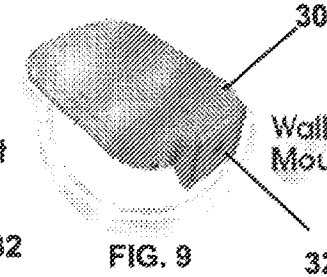

As shown in FIG. 2, with the selection of a greater number of the LED light modules 18, the LED light fixture 10 requires overall greater length. To accommodate this length, the length L of each of the first rail 14, the second rail 16 and the housing cover 20 may be appropriately adjusted. Preferably, each of the first rail 14, the second rail 16 and the housing cover 20 is extrusion-formed so as to have a constant profile over its respective length. In addition, each of the first rail 14, the second rail 16 and the housing cover 20 may be formed to accommodate the greatest target number of the LED light modules 18, for example, five of the LED light modules 18. For any application less than the greatest number of the LED light modules 18, the first rail 14, the second rail 16 and the housing cover 20 may be shortened, for example, by cutting, to the appropriate length. This allows for the maintenance of inventory of a limited number of pieces. Moreover, with the LED light fixtures 10 being scalable along a longitudinal axis thereof, a single configuration of the front end cap 12 is also required—the front end cap 12 is useable with all lengths of the LED light fixture 10 without any modification. In addition or alternatively, one or more of the first rail 14, the second rail 16 and the housing cover 20 may be maintained in inventory in various lengths L, thus avoiding the need to cut such pieces.

A volume 28 is preferably defined within the LED light fixture 10 for accommodating the LED light modules 18. The LED light modules 18 may be mounted to portions of the LED light fixture 10, such as the housing cover 20 or a heat dissipation element. As will be appreciated by those skilled in the art, the LED light modules 18 may be retained within the LED light fixture 10 using various configurations. By way of non-limiting example, the first rail 14 and the second rail 16 may each include an inwardly facing depression into which a portion of the LED light modules 18 may be seated. The bases 24 of the LED light modules 18 may be extended beyond the LED light elements 26 to provide surface area for being retentively engaged by the first and second rails 14, 16 without significantly obscuring any generated light.

The back end 22 includes a rear end cap 30 which is similarly dimensioned to the front end cap 12. Like the first end cap 12, the rear end cap 30 may be used with all lengths of the LED light fixture 10. In forming the LED light fixture 10, the first rail 14, the second rail 16 and the housing cover 20 extend between the front end cap 12 and rear end cap 30 so as to generally perimetrically bound the LED light modules 18 and define the volume 28. As will be appreciated, the volume 28 is not required. The LED light modules 18 may be retained without being wholly within an internal volume of the LED light fixture 10.

Figure 10:
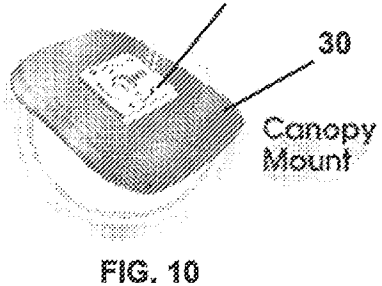

The back end 22 is configured to accommodate various mounting arrangements. As can be seen in FIGS. 3-10, different mounting elements 32 may be provided with the LED light fixture 10 to provide various mounting options. For example, the mounting element 32 may be configured for trunnion mounting (FIG. 3), tennon mounting (FIG. 4), slip fitter mounting (FIG. 5), rigid surface mounting (FIG. 6), adjustable surface mounting (FIG. 7), pole mounting (FIG. 8), wall mounting (FIG. 9), and canopy mounting (FIG. 10). The mounting element 32 may be rigid, e.g., rigid surface mounting (FIG. 6), or adjustable, e.g., adjustable surface mounting (FIG. 7), having one or more degrees of freedom of adjustment (e.g., pivoting about one or more axes). The mounting element 32 may be fixed to the back end 22 or to the housing cover 20 (FIG. 10). The back end 22 may be maintained in inventory with each of the configurations shown in FIGS. 3-10. It is understood that with canopy mounting, the mounting element 32 is separate from the back end 22—the back end 22 being configured for such canopy mounting.

Optionally, a heat dissipation element 50 may be provided in between the LED light module 18 and the housing cover 20. The heat dissipation element 50 preferably has features, such as fins 52, which increase the back surface area thereof. With the LED light modules 18 being located adjacent to the heat dissipation element 50, generated heat from the LED light modules 18 may be more efficiently dissipated. Preferably, the bases 24 and the heat dissipation element 50 are formed of material with good thermal conductive properties, such as a metallic material.

In a preferred arrangement, the heat dissipation element 50 is formed integrally with the first rail 14 and the second rail 16, as shown in FIG. 1. With this arrangement, the heat dissipation element 50 will have its length L adjusted uniformly with the first and second rails 14, 16 as needed. Also, preferably, the heat dissipation element 50 has a constant cross-section along its length thereof. The heat dissipation element 50 may be extruded with the first and second rails 14, 16. Optionally, the heat dissipation element 50 may be maintained in inventory with varying lengths L.

Various techniques may be used to secure the components of the LED light fixture 10 together. By way of non-limiting example, threaded apertures 54 may be provided in the back end 22 to engage long bolts or threaded stems which extend through openings 56 in the front end cap 12 and which extend through the first and second rails 14, 16. The apertures 54 need not be threaded with appropriate hardware, such as nuts, being utilized to secure the components of the LED light fixture 10.

With the subject invention, a plurality of the LED light fixtures 10 may be configured with different wattage outputs and different mounting features to allow for different lighting applications at a single site with uniformly appearing lighting fixtures. For example, higher output parking lot lighting, which, for example, may be pole mounted, may be complemented with lower output wall-mounted pathway lighting and lower output overhead, near-doorway canopy lighting with all fixtures being visually similar in appearance.

What is claimed is:

1. A system for preparing scalable, variable-mounting LED lighting fixtures, the system comprising:

an inventory of front end caps;

an inventory of first and second rails;

an inventory of LED light modules;

an inventory of housing covers; and, an inventory of back ends, said back ends including different mountings, wherein, differently-scaled LED lighting fixtures with different mountings may be formed based on said inventories.

2. A system as in claim 1, further comprising an inventory of heat dissipation elements.

3. A system as in claim 2, wherein at least a portion of said heat dissipation elements is formed integrally with said first and second rails.

4. A system as in claim 1, wherein each said inventory includes similarly-formed elements.

5. A system as in claim 1, wherein said different mountings include trunnion mounting, tennon mounting, slip fitter mounting, rigid surface mounting, adjustable surface mounting, pole mounting, wall mounting, and canopy mounting.

6. A system as in claim 1, wherein said first and second rails each have a constant cross-section along a respective length thereof.

7. A system as in claim 1, wherein each said back end of said set includes a similarly-configured rear end cap.

* * * * *